United States Patent [19]

Ringel et al.

[11] Patent Number: 4,514,296

[45] Date of Patent: Apr. 30, 1985

[54] APPARATUS FOR PRODUCING ION EXCHANGE PARTICLES CHARGED WITH URANYL IONS

[75] Inventors: Helmut Ringel, Niederzier-Hambach; Erich Zimmer, Jülich; Nabil Abdelmonem, Niederzier-Hambach, all of Fed. Rep. of Germany

[73] Assignee: Kernforschungsanlage Jülich, Gesellschaft mit beschränkter Haftung, Jülich, Fed. Rep. of Germany

[21] Appl. No.: 222,640

[22] Filed: Jan. 5, 1981

Related U.S. Application Data

[62] Division of Ser. No. 926,103, Jul. 19, 1978, Pat. No. 4,279,866.

[30] Foreign Application Priority Data

Jul. 23, 1977 [DE] Fed. Rep. of Germany ..... 2733396

[51] Int. Cl.[3] ..... B01J 8/08

[52] U.S. Cl. ..... 210/96.1; 210/189; 210/268; 422/62; 422/159

[58] Field of Search ..... 423/7; 264/0.5; 210/96.1, 189, 268, 274, 284; 422/159, 62

[56] References Cited

U.S. PATENT DOCUMENTS

| | | | |
|---|---|---|---|
| 3,307,700 | 3/1967 | Nevers | 210/189 |
| 3,438,749 | 4/1969 | Louadier et al. | 264/0.5 |
| 3,573,004 | 3/1971 | Abrams et al. | 210/189 |
| 3,649,203 | 3/1972 | Schneider | 422/62 |
| 3,800,023 | 3/1974 | Haas | 423/7 |
| 3,995,009 | 11/1976 | Notz | 423/7 |
| 4,035,292 | 7/1977 | Hinsley | 210/189 |
| 4,070,438 | 1/1978 | Notz et al. | 423/7 |
| 4,217,217 | 8/1980 | Kay et al. | 210/96.1 |

OTHER PUBLICATIONS

Haas, "HTGR Fuel Development, Loading of Uranium or Carboxylic Acid Cation-Exchange Resin Using Solvent Extraction of Nitrate", ORNL-TM-4955, pp. 1-12 (1975).

*Primary Examiner*—Edward A. Miller

*Attorney, Agent, or Firm*—Karl F. Ross; Herbert Dubno

[57] ABSTRACT

An apparatus charges weakly acidic cationic ion exchange resin particles with uranyl ions by contacting the particles stepwise with aqueous uranyl nitrate solution at higher uranium concentrations from stage to stage. An alkaline medium is added to the uranyl nitrate solution in each stage to increase the successive pH values of the uranyl nitrate solution contacting the particles in dependance upon the uranium concentration effective for maximum charging of the particles with uranyl ions.

4 Claims, 1 Drawing Figure

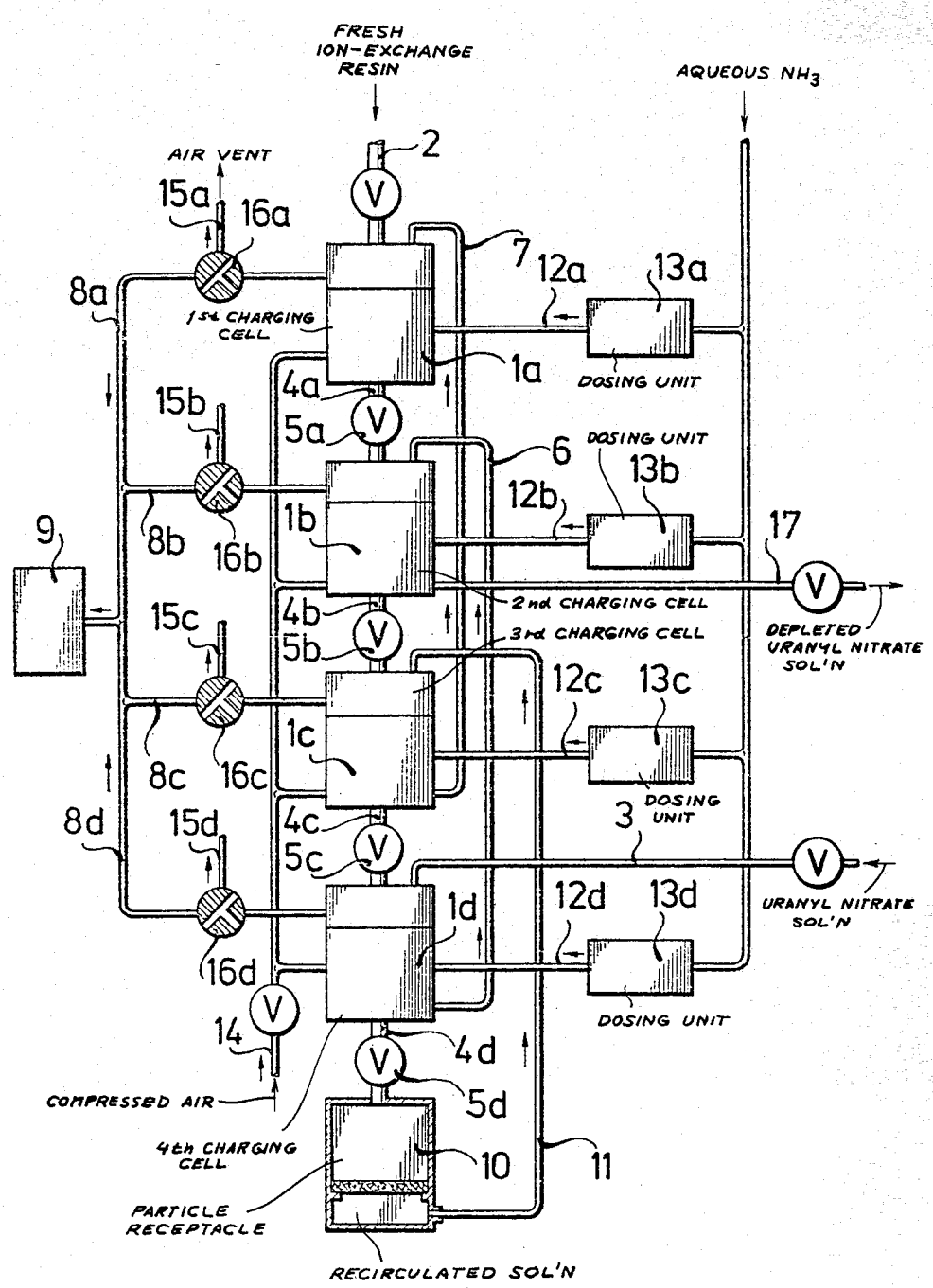
FRESH ION-EXCHANGE RESIN
AQUEOUS $NH_3$
AIR VENT
2
15a
16a
7
12a
13a
8a
1st CHARGING CELL
1a
DOSING UNIT
4a
15b
5a
6
DOSING UNIT
13b
12b
1b
17
9
8b
16b
2nd CHARGING CELL
4b
15c
5b
3rd CHARGING CELL
DEPLETED URANYL NITRATE SOL'N
12c
13c
1c
8c
16c
DOSING UNIT
3
8d
15d
4c
5c
URANYL NITRATE SOL'N
1d
12d
13d
16d
DOSING UNIT
14
4d
COMPRESSED AIR
5d
4th CHARGING CELL
10
11
PARTICLE RECEPTACLE
RECIRCULATED SOL'N

APPARATUS FOR PRODUCING ION EXCHANGE PARTICLES CHARGED WITH URANYL IONS

This is a division of application Ser. No. 926,103, filed July 19, 1978, now U.S. Pat. No. 4,279,866.

FIELD OF THE INVENTION

The present invention relates to an apparatus for charging particles of weakly acidic cationic ion exchange resin with uranyl ions by contacting the resin particles with a uranyl nitrate solution.

BACKGROUND OF THE INVENTION

The charging of ion exchange resin particles with uranyl ions is an early stage in the production of nuclear fuel particles for fuel elements for nuclear reactors.

The ion exchange resin particles of a cationic ion exchange resin have diameters of about 0.6 millimeter and, upon charging with uranyl ions, are converted into nuclear fuel particles in respective carrier bodies. In general, the uranyl-ion-charged particles are dried in air at temperatures slightly above 100° C. and then are coked in a protective gas atmosphere at temperatures between 300° and 1200° C. The particles are sintered to uranium oxycarbide nuclear fuel particles at temperatures up to 1800° C. This process is described, for example, in U.S. Pat. No. 3,438,749 for the production of plutonium oxide particles.

For an especially high concentration of uranium in particles of weakly acidic cationic ion exchange resins, mainly two principal parameters must be taken into consideration, these parameters being mutually related. The two parameters are the concentration of uranyl ions in the uranyl nitrate aqueous solution, which should be as high as possible, and the pH of the uranyl nitrate solution.

It has already been described in German Patent DT-PS No. 2,324,792 (see U.S. Pat. No. 3,800,023) that the uranium concentration and the pH value in the uranyl nitrate solution can be adjusted by the addition of $UO_3$ powder. The $UO_3$ powder must, however, be produced separately since the uranium is generally present as an aqueous uranyl nitrate solution.

In the Oak Ridge National Laboratory publication ORNL-TM-4955 of 1975, there is described a process in which the pH value is established by extraction of the nitrate ions from the solution with a liquid anion exchanger in a special extraction column. Apart from the extraction apparatus for the uranyl nitrate solution, this process requires the regeneration of the extraction agent. In addition, the uranium concentration of the uranyl nitrate solution must be held constant by evaporation of the solution. The process is thus associated with expensive apparatus and with high operating costs.

OBJECT OF THE INVENTION

The object of our present invention is to provide an improved apparatus for the production of nuclear particles charged with uranyl ions which is simpler, operates at lower cost than conventional systems of this type and which makes use of low-cost chemical agents to yield a practically uranium-free solution at the conclusion of the charging stages carried out by the apparatus.

SUMMARY OF THE INVENTION

This object is attained, in accordance with the apparatus of our invention, by contacting the weakly acidic cationic ion exchange resin particles stepwise with a uranyl nitrate solution which from step to step has a higher uranium concentration, in each stage the uranium concentration being adjusted by the addition of an alkaline agent which establishs a pH value for each stage in dependence upon the uranium concentration which corresponds to the maximum charging of the cationic ion exchange resin with uranyl ions for the particular stage.

The pH which is to be established in each stage can be readily determined empirically by the addition of ammonium hydroxide or ammonia and set at that pH value at which the precipitation reaction begins.

The maximum pH value of the uranyl nitrate solution is thus maintained during the charging process by dripping the alkaline agent, preferably ammonium hydroxide, into the solution to maintain the pH constant. Advantageously, the stepwise contacting of the resin particles with the uranyl nitrate solution whose concentration is increased from stage to stage is carried out by passing the uranyl nitrate solution and the particles in counterflow to one another. It has been found that when this is done, and in addition the pH value in each stage is adjusted in dependence upon the uranium concentration to the maximum pH which can be used before precipitation begins, an extremely high concentration of uranyl ions can be provided in the resin particles.

The aforedescribed process can be carried out by the apparatus of the invention in such a number of stages, i.e. at least two, that the solution after the last stage is practically free from uranyl ions. The particles obtained have been found to be uniformly charged reproducibly with an especially large quantity of the uranyl ions.

As already noted, the best mode contemplated for the apparatus in carrying out the invention is to pass the particles from stage to stage and the solution from stage to stage in opposite directions, i.e. in counterflow.

The fresh resin particles are thus initially brought into contact with the uranyl nitrate solution of lowest uranyl ion concentration and ultimately into contact with the uranyl nitrate solution with the highest uranyl ion concentration. In the first contacting stage, practically all of the residual uranium in the solution is bound into the resin particles and the solution is rendered uranium free. In the final contacting stage in which the resin particles from a preceeding contacting stage are brought into contact with uranyl nitrate solution of the highest uranyl ion concentration, it is found that the particles have a high uranyl ion content, so that, after drying, coking and sintering, the nuclear fuel particles will have a maximum uranium level.

The pH value of the uranyl nitrate solution, during the process, can range between 1.8 for the highest uranyl ion concentration to about 3.5 for the lowest uranyl-ion concentration.

So that the precipitate of uranium in the uranyl nitrate solution which may be formed locally by momentary higher concentrations of ammonia can be resolubilized, in each stage the resin particles and metal nitrate solution are continuously mixed. In other words each contacting stage can be provided with mixing means to insure a thorough agitation of the resin particles and the solution with one another.

The establishment of the charging equilibrium between the resin particles and the concentration of the uranyl nitrate solution is accelerated by maintaining the temperature in each charging stage between 60° and 80°

C. Optimum results are obtained at a temperature of about 70° C.

The apparatus of our invention comprises a plurality of charging cells, one for each of the charging stages, and within which the particles of the cationic ion exchange resin are brought into intensive contact with the aqueous uranyl nitrate solution containing the uranyl ions.

Advantageously, the apparatus includes closeable conduits for passing the resin particles from stage to stage, each of the cells being also provided with a conduit connected with a dosing device for the alkaline agent.

A first of the charging stages is provided with a closeable conduit for introducing fresh resin particles while the last-stage cell is provided with a feed conduit for the fresh uranyl nitrate solution. The feeding of the uranyl nitrate solution from cell to cell is preferably effected also by closeable pipes or ducts. Advantageously, the conduits can be provided with pumps or the like, where desired or necessary, to effect the counterflow of the resin and the uranyl nitrate solution. The second charging cell can be provided with a closeable fitting enabling withdrawal of a residual solution having a reduced uranyl ion concentration and the last cell can be provided with a closeable conduit for transferring the particles charged with the uranyl nitrate solution to a storage vessel from which any excess liquid can be drained by appropriate means.

The apparatus described above has been found to be highly advantageous in that it enables the optimum pH value to be established in each contact cell by the introduction of the alkali agent.

The alkali agent is, preferably, an ammoniacal aqueous solution and, as noted, the apparatus may be provided with means for maintaining a pH between 1.8 and 3.5 constant during the contacting process in each cell.

After each contact stage in one of the contacting cells, the particles together with the uranium nitrate solution are transferred to the next contacting cell. Since the particles are suspended by agitation in this uranium nitrate solution, such transport is facilitated if the cells are located one below the other, i.e. in a vertical orientation so that the transfer is effected primarily by gravity.

After transfer of the particles and the solution to the next cell, the uranyl nitrate solution having a reduced uranyl ion concentration is removed from the latter cell and passed to the appropriate higher cell, each time skipping a cell from which that solution was withdrawn during the transfer.

As a consequence, the uranyl nitrate solution is moved up one cell during each phase of the treatment and the particles are moved down one cell during each phase.

According to a further feature of the invention, in the bottom of each of the charging cells, a gas-supply duct, connected to a compressed air source, is provided and opens so that air can be bubbled through the cell to agitate intimately the particles and the uranyl nitrate solution as well as any precipitation products which may form in each cell because of the higher concentration of the ammonium hydroxide at the locations at which the latter is dripped into the cell. Preferably, the charging cells are heatable so that a temperature of 60° to 80° C. is maintained, the preferred temperature being 70° C. as already noted.

Most effective results are obtained when the concentration of the fresh uranyl nitrate solution has a maximum of 1.5 moles per liter of uranyl ions.

BRIEF DESCRIPTION OF THE DRAWING

The above and other objects, features and advantages of the present invention will become more readily apparent from the following description, reference being made to the sole FIGURE of the drawing which is a flow diagram illustrating an apparatus for carrying out the invention in practice.

SPECIFIC DESCRIPTION

As can be seen in the drawing, the apparatus of the present invention comprises four charging cells 1*a*, 1*b*, 1*c* and 1*d*, located one above the other in a vertical contacting cascade.

In the first of these contacting cells, i.e. the charging cell 1*a*, a closeable feed conduit 2 is adapted to introduce fresh ion exchange resin particles. In this description, a closeable conduit will be understood to mean a conduit which can be provided with a valve or other means for effecting the transfer of liquid and/or particles. Where necessary, of course, pumps can be provided to act simultaneously as the closing or blocking means (i.e. when the pump is shut off) and as the displacing means for the liquid or the particles or both.

The resin particles pass from one cell 1*a* downwardly from cell to cell to the last cell 1*d* and thus move downwardly. This uranyl nitrate solution, on the other hand, passes upwardly through the cascade.

Fresh uranyl nitrate solution is supplied by the closeable conduit 3 to the last contacting cell 1*d* and can be displaced upwardly, e.g. by suction as required.

The uranyl ion concentration decreases from cell to cell upwardly while the uranium content of the particles increases step wise from stage to stage downwardly.

For the transport of the particles between the contacting cells, ducts 4*a*–4*c* with closing means such as valves 5*a*–5*c* are provided. The particles are transferred together with the uranyl nitrate solution from each upper cell to the next lower cell. From this next lower cell, transport ducts 6 and 7 are provided, each skipping a cell, so as to connect cell 1*d* with cell 1*b* and cell 1*c* with cell 1*a*, respectively. Consequently, once the particles are transferred to cell 1*b* together with the uranyl nitrate solution, the uranyl solution is withdrawn via the pipe 17. The solution for contacting the particles in cell 1*b* is withdrawn via pipe 6 from cell 1*d* to which the solution has been transferred from cell 1*c*.

Cell 1*d* is connected with a reservoir 10 into which the particles are finally discharged, the receptacle 10 being provided with a strainer through which excess liquid can percolate to be passed via pipe 11 into cell 1*c*.

Each contacting cell 1*a*–1*d* is also provided with a pipe 12*a*–12*d* for the introduction of aqueous ammonia solution. The pipes 12*a*–12*d* are connected with respective dosing devices 13*a*–13*d* which are capable of maintaining the desired pH in each contact cell. The dosing units 13*a*–13*d* may be connected with pH electrodes immersed in each cell and operated after establishment of the optimum pH therein by the empirical means described previously.

The pH values are maintained between 1.8 and 3.5 in the manner previously described.

Each of the charging cells 1*a*–1*d* is additionally provided with a gas line connected to a compressed air source represented at 14 and an appropriate valve. The gas lines bubble compressed air into the respective cells to intimately mix the uranyl nitrate solutions and resin particles therein.

The air is discharged through outlets 15*a*–15*d*, respectively. The outlets are controlled by three-way valves 16*a*–16*d* respectively.

The cells 1*a*–1*d* are provided with heating elements (not shown) which maintain temperatures between 60° and 80° and preferably about 70° C. in each cell.

OPERATION AND SPECIFIC EXAMPLE

The cascade shown in the drawing is operated by introducing into the cell 1*d* a uranyl nitrate solution with a uranium concentration of about one mole per liter. Ammonia is added so as to maintain the pH of the solution in this cell at a value of 2.35. The uranyl nitrate solution supplied to cell 1*c* is at a concentration (of uranium) of 0.58 moles per liter. The pH value is here established at about 2.45. The uranyl nitrate solution in cell 1*b* is 0.04 moles per liter of uranium and the pH value is set at 3.0. In the first stage cell 1*a*, the concentration of the uranyl nitrate solution can be less than 0.000004 moles per liter of uranium and the pH value is maintained at 3.5.

The fresh ion exchange particles are introduced into cell 1*a* and the solution drained therefrom via cell 1*b* and line 17 in the manner described is practically free from uranium. The particles which remain in cell 1*b* contain less than one part per million of uranium.

In cell 1*b*, the particles are charged to 0.16 grams of uranium per gram of the pure dried resin. In cell 1*c*, this uranium level is raised to 0.82 grams of uranium per gram of the pure dried resin.

In cell 1*d*, the particles are charged with 1.15 grams of uranium per grams of the pure dried resin. The residence time of the ion exchange resin in each of the cells is about 20 minutes.

The particles are then processed in the usual manner by drying, cokefication, sintering, etc. to produce the nuclear fuel particles.

We claim:

1. An apparatus for charging weakly acidic cationic ion exchange resin particles with uranyl ions comprising:

at least two contactors arranged in a vertical cascade one above the other;

means for introducing fresh resin particles into the uppermost contactor;

closeable conduits connecting said uppermost contactor with the next lower contactor and connecting the next lower contactor with a further contactor therebelow;

means for introducing a uranyl nitrate solution having relatively high uranyl ion concentration into said further contactor;

means for transferring uranyl nitrate solutions of progressively reduced uranyl ion concentration from said further contactor to said next lower contactor and from said next lower contactor to said uppermost contactor;

means for withdrawing a depleted solution from said next lower contactor; and means for metering the flow of an alkaline agent into each of said contactors to maintain a pH level therein optimum for the maximum transfer of uranyl ions to the particles therein.

2. The apparatus defined in claim 1 wherein four such contactors are arranged in a cascade, the lowermost contactor being disposed beneath said further contactor and being connected thereto by a closeable conduit, said apparatus further comprising means for introducing a fresh uranyl nitrate solution into said lowermost contactor;

means for recovering uranyl nitrate solution and particles from said lowermost contactor and separating the latter solution therefrom; and means for transferring the separated latter solution to said further contactor.

3. The apparatus defined in claim 2, further comprising means for introducing compressed air into each of said contactors for intimately mixing the particles with the solution therein.

4. The apparatus defined in claim 3, further comprising means for maintaining each of said contactors at a temperature of between 60° and 80° C.

* * * * *